US010982427B2

(12) United States Patent
Wong et al.

(10) Patent No.: US 10,982,427 B2
(45) Date of Patent: Apr. 20, 2021

(54) PREFABRICATED BATHROOM AND METHODS FOR CONSTRUCTING AND INSTALLING THE SAME

(71) Applicant: Yau Lee Wah Construction Materials (Huizhou) Company Limited, Huizhou (CN)

(72) Inventors: Conrad Tin Cheung Wong, Shenzhen (CN); Rosana Wai Man Wong, Shenzhen (CN)

(73) Assignee: Yau Lee Wah Construction Materials (Huizhou) Company Limited, Huizhou (CN)

( * ) Notice: Subject to any disclaimer, the term of this patent is extended or adjusted under 35 U.S.C. 154(b) by 0 days.

(21) Appl. No.: 16/455,226

(22) Filed: Jun. 27, 2019

(65) Prior Publication Data

US 2020/0199868 A1 Jun. 25, 2020

(30) Foreign Application Priority Data

Dec. 19, 2018 (CN) ..... 201811552031.2

(51) Int. Cl.
*E04B 1/348* (2006.01)
*E04G 1/12* (2006.01)
*E04H 1/12* (2006.01)

(52) U.S. Cl.
CPC ..... *E04B 1/34869* (2013.01); *E04H 1/1266* (2013.01)

(58) Field of Classification Search
CPC ..... E04H 1/1266; E04B 1/34869; E04B 2/84; E04B 1/16; E04B 1/04
See application file for complete search history.

(56) References Cited

U.S. PATENT DOCUMENTS 3,812,637 A 5/1974 Yang et al.
4,018,021 A * 4/1977 Dow ..... E04B 1/04 52/251

(Continued)

FOREIGN PATENT DOCUMENTS

CN 201520298272.4 5/2015
CN 204645727 U 9/2015
SG 184609 A1 10/2012

OTHER PUBLICATIONS

European Search Report dated Nov. 21, 2019 in European Patent Application No. 19173948.1.

*Primary Examiner* — Andrew J Triggs
(74) *Attorney, Agent, or Firm* — Kim IP Law Group LLC

(57) ABSTRACT

Disclosed herewith a prefabricated bathroom and a construction method and an installation method thereof. The prefabricated bathroom includes a bottom unit (11), multiple wall units (12) and a top plate unit (13). One of the wall units (12) is a structural wall (14), which is provided with a recessed top region (141) reserved for later pouring, a middle full-prefabricated structural wall body (142), and a recessed bottom region (143) reserved for later pouring. Top exposed reserve bars (144) of the prefabricated bathroom of a floor are inserted into the recessed bottom region (143) of the prefabricated bathroom of a next floor, and connected with bottom exposed reserve bars (146) thereof, so that the prefabricated bathroom of said floor can be connected with that of said next floor through pouring concrete in the recessed top region (141) and the recessed bottom region (143).

10 Claims, 16 Drawing Sheets

(56) References Cited

U.S. PATENT DOCUMENTS

| | | | | |
|---|---|---|---|---|
| 4,145,861 | A * | 3/1979 | Yarnick | E02D 27/34 52/294 |
| 9,068,340 | B2 * | 6/2015 | Austin | E04B 1/348 |
| 9,376,802 | B2 * | 6/2016 | Tao | E04H 1/1266 |
| 9,593,478 | B2 * | 3/2017 | Austin | E04B 1/20 |
| 10,287,782 | B2 * | 5/2019 | Krokfors | E04B 1/34869 |
| 2002/0059763 | A1 * | 5/2002 | Wong | E04B 1/34823 52/378 |
| 2013/0152485 | A1 * | 6/2013 | Austin | E04B 1/34807 52/79.8 |
| 2014/0099456 | A1 * | 4/2014 | Raghavendran | E04C 5/07 428/34.4 |
| 2014/0338283 | A1 * | 11/2014 | Huang | E04B 1/24 52/741.2 |
| 2015/0354202 | A1 * | 12/2015 | Austin | E04B 1/348 52/79.7 |
| 2017/0342704 | A1 * | 11/2017 | Austin | E04H 1/005 |

* cited by examiner

PREFABRICATED BATHROOM AND METHODS FOR CONSTRUCTING AND INSTALLING THE SAME

TECHNICAL FIELD

The invention relates to buildings, more specifically to a prefabricated bathroom and methods for constructing and installing the prefabricated bathroom. The invention can be widely applied in a variety of high-rise buildings.

BACKGROUND

Bathroom is an essential part of residential or commercial buildings. Currently, there are two ways for constructing the bathroom. One is to use cast-in-situ concrete frame at a construction site directly, and then build the bathroom one plate by one plate. This is the most conventional bathroom constructing method widely used, which, however, takes a long construction period with a high construction cost. Moreover, since the building materials used may be out of standard, quality of the bathroom thus built cannot be satisfactorily ensured. The other way is to prefabricate a whole-set bathroom at factories, and then deliver it to the construction site for installation.

Chinese Utility Model Patent No. 201520298272.4 discloses a prefabricated bathroom, wherein four walls of the prefabricated bathroom include at least one wall, or part of at least one wall, that is a semi-prefabricated structural wall, which has a relatively small thickness. An outer surface of the semi-prefabricated structural wall is provided, along a normal direction thereof, with a plurality of protruding columns, each top surface thereof being provided with a bolt for accurately positioning and installing a cast-in-situ wall template. Therefore, the bolt, which is used for fixing the prefabricated bathroom, can pass through the protruding column, which is used for fixing the cast-in-situ wall template. The above construction method has the following disadvantages. Specifically, the installation is inconvenient and the procedure thereof is complicated; a large amount of construction materials have to be delivered, so that the cost is significant; the construction is inconvenient and time consuming; and the prefabricated bathroom is not equipped with bathtub and bathroom, so that the facility is not complete.

SUMMARY OF THE INVENTION

Based on the above-mentioned disadvantages, the present invention aims to provide a prefabricated bathroom, which has a satisfactory bearing capacity, and can be constructed conveniently without use of protruding columns and in-situ casting.

The prefabricated bathroom according to the present invention comprises a bottom unit, multiple wall units and a top plate unit that are connected to each other in a securing manner. One of the wall units is a structural wall, which is provided, at its top portion, with a recessed top region reserved for later pouring, the recessed top region being provided therein with top exposed reserve bars. The structural wall is configured as a full-prefabricated structural wall body at its middle portion, and is provided, at its bottom portion, with a recessed bottom region reserved for later pouring, the recessed bottom region being provided therein with bottom exposed reserve bars. The top exposed reserve bars of the prefabricated bathroom of a floor are inserted into the recessed bottom region of the prefabricated bathroom of a next floor, and connected with the bottom exposed reserve bars thereof, so that the prefabricated bathroom of said floor can be connected with the prefabricated bathroom of said next floor through pouring concrete in the recessed top region and the recessed bottom region.

In one embodiment, the bottom plate unit and the low portions of the wall units are provided with a glass reinforced plastic material layer.

In one embodiment, the recessed top region and the recessed bottom region are arranged on an outer side of the structural wall, and the inner sides of the recessed top region and the recessed bottom region are provided with toothed engagement surfaces respectively.

In one embodiment, the prefabricated bathroom is provided therein with a toilet and a bathtub.

In one embodiment, one of the wall units other than the structural wall extends outwardly to form an exterior wall unit, the end of which is provided with side exposed reserve bars.

The present invention further proposes a method for constructing the prefabricated bathroom, comprising the following steps: building the bottom plate unit and the lower portions of said multiple wall units with a bottom plate steel mold and a vertical steel mold, bundling the bars of the bottom plate unit and the wall units, and pouring concrete; forming the recessed bottom region reserved for later pouring at a bottom part of the structural wall, and providing exposed bars in the recessed bottom region; building the upper portions of said multiple wall units and the top plate unit with a vertical steel mold of the wall units and a top mold arranged at the top of the top plate unit, bundling the bars of the top plate unit and the wall units, and pouring concrete; and forming the recessed top region reserved for later pouring at a top part of the structural wall, and providing exposed bars in the recessed top region.

In one embodiment, the step for building the bottom plate unit and the lower portions of said multiple wall units further includes: disposing the glass reinforced plastic material layer at a position of the bottom plate unit before bundling the bars of the bottom plate unit and the wall units, wherein edges of the glass reinforced plastic material layer extend upwardly to the lower portions of the wall units.

The present invention further proposes a method for installing the prefabricated bathroom, comprising the following steps: Step A, lifting the prefabricated bathroom to a designated position of a floor plate of a floor to be installed with the prefabricated bathroom; Step B, bundling the bottom exposed reserve bars of the recessed bottom region of the structural wall with the top exposed reserve bars of the prefabricated bathroom of a next floor that are inserted into said recessed bottom region together, forming a bar mesh; and Step C, installing a cast-in-situ wall template outside said recessed bottom region, and pouring concrete in said recessed bottom region to form a cast-in-situ wall.

In one embodiment, after Step C the method further includes: Step D, establishing scaffolds around the prefabricated bathroom of said floor at positions where the floor plate is poured, and lifting a semi-prefabricated floor plate to the prefabricated bathroom and mounting it on the top of the scaffolds; and Step E, bundling bars on the top of prefabricated bathroom and on the top of the semi-prefabricated floor plate to form a bar mesh, on which concrete is poured to form the whole floor plate.

In one embodiment, in Step F, concrete is further poured in the recessed top region of the prefabricated bathroom of said next floor during pouring the floor plate.

Compared with the prior arts, the present invention has the following technical advantages. First, one of the wall units is a structural wall, which increases the bearing capacity, and enables the bathroom being constructed stronger. Second, according to the present invention, the top exposed reserve bars of the prefabricated bathroom on a floor are inserted into the recessed bottom region of the prefabricated bathroom on an upper floor and connected with the bottom reserved bars thereof. By means of which, precise positioning and installing procedures are unnecessary, and protruding columns and bolts are also dispensed. Therefore, the construction process is greatly facilitated and the construction efficiency is improved. Third, according to the constructing method for the prefabricated bathroom of the present invention, the bottom plate unit and the bottom portions of the wall units are poured with concrete as a whole in one time, and the top plate unit and the top portions of the wall units are poured with concrete as a whole in one time. Therefore, the construction process is facilitated, the joints formed are tight, and the waterproof performance of the prefabricated bathroom is improved. Finally, according to the installing method for the prefabricated bathroom of the present invention, the top exposed reserve bars of the prefabricated bathroom on a floor are inserted into the recessed bottom region of the prefabricated bathroom on a next floor and connected with the bottom reserved bars thereof, and through pouring concrete in the recessed top region reserved for later pouring and the recessed bottom region reserved for later pouring, the prefabricated bathroom of said floor is connected with the prefabricated bathroom of said next floor. By means of which, precise positioning and installing procedures are unnecessary, and protruding columns and bolts are also dispensed. Therefore, the construction process is greatly facilitated and the construction efficiency is improved.

PREFERRED EMBODIMENTS OF THE INVENTION

In the following the present invention will be described in details with reference to the attached drawings and embodiments in order to enable the objective, technical solution and advantages of the present invention being more distinct. It should be understood that the particular embodiments as set forth herewith are intended to be illustrative, not to limit the scope of the invention in any way.

Figure 1:
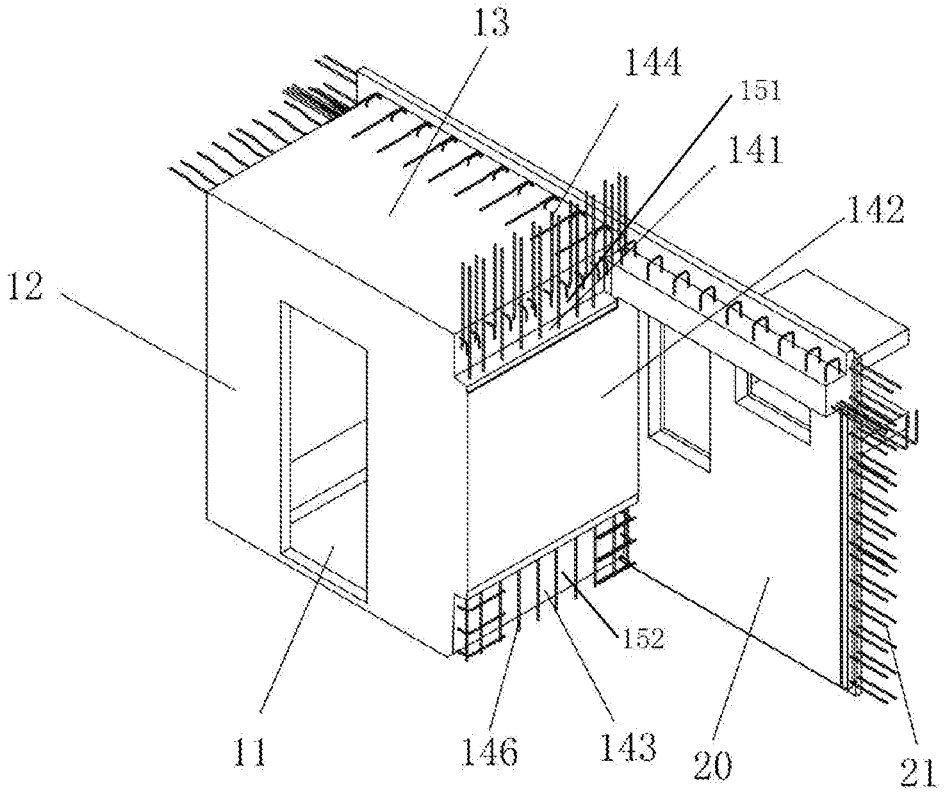
FIG. 1 schematically shows the whole structure of a prefabricated bathroom according to the present invention.
Figure 26:
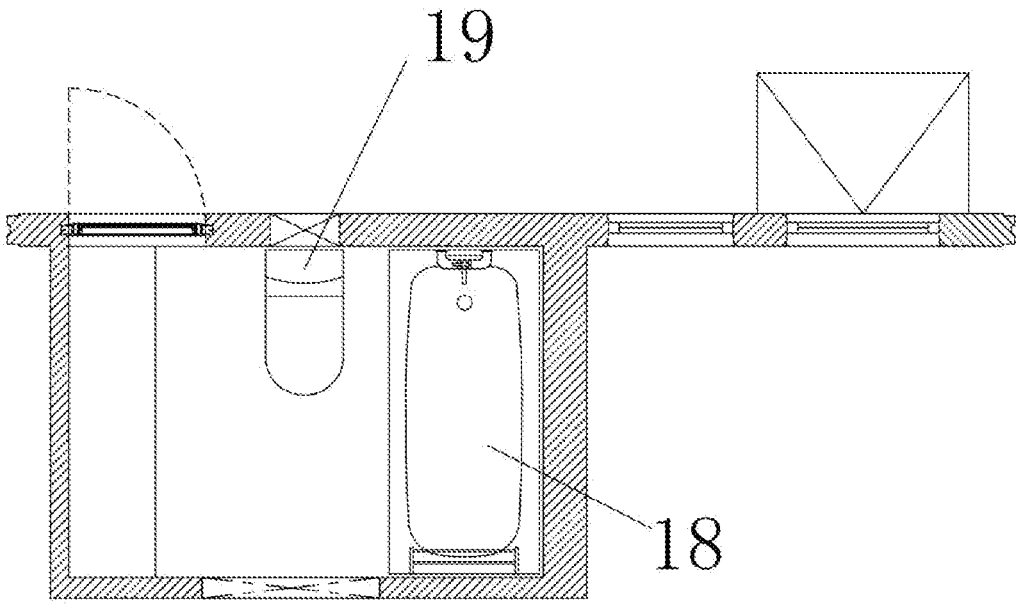
FIG. 26 schematically shows a horizontal cross sectional view of the plan structure of the prefabricated bathroom according to the present invention.

As shown in FIGS. 1 and 26, the prefabricated bathroom 100 according to the invention comprises a bottom plate unit 11, a plurality of wall units 12, and a top plate unit 13 that are connected to each other in a securing manner. The prefabricated bathroom 100 is further provided therein with a bathroom 19 and a bathtub 18. The wall unit 12 may be provided with a door and/or a window, and pre-embedded therein with water supply/drainage pipes, wire conduits, and light control boxes. At least one of said plurality of wall units 12 is a main structural wall 14. The main structural wall 14 has a relatively large thickness, and thus requires a large amount of bars. The use of the main structural wall 14 can increase the bearing capacity of the wall, enabling the bathroom being constructed stronger.

One or more of the wall units 12 other than the structural wall 14 may extend outwardly to form an exterior wall unit 20, the end of which may be provided with side exposed reserve bars 21. During construction, the length of the exterior wall unit 20 can be prefabricated according to the on-site size. During the on-site installation of the prefabricated bathroom, transverse bars and vertical bars can be provided at the side exposed reserve bars 21, so as to form a side bar mesh 16 (see FIG. 19). Then, a cast-in-situ wall template is installed, so that the exterior wall unit 20 can be connected with other prefabricated structures or cast-in-situ structures by pouring concrete therewith. The prefabricated bathroom and the extending exterior wall unit 20 are prefabricated into one piece, thus reducing the possibility of water seepage in the bathroom, and improving the waterproof performance of the bathroom.

The structural wall 14 has: a recessed top region 141, which is, as a semi-prefabricated structure, reserved for later pouring; a middle region 142, which is a full-prefabricated structural wall body; and a recessed bottom region 143, which is, also as a semi-prefabricated structure, reserved for later pouring. The recessed top region 141 reserved for later pouring is provided with top exposed reserve bars 144, and the recessed bottom region 143 reserved for later pouring is provided with bottom exposed reserve bars 146. In order to increase the bonding force between the prefabricated concrete and the cast-in-situ concrete, a tooth-shaped engaging surface may be provided on inner walls of the recessed top region 141 reserved for later pouring and the recessed bottom region 143 reserved for later pouring. The top exposed reserve bars 144 of the prefabricated bathroom 100 on a floor are inserted into the recessed bottom region 143 of the prefabricated bathroom 100 on an upper floor, and connected to the bottom exposed reserve bars 146 thereof. Through pouring concrete in the recessed top region 141 reserved for later pouring and the recessed bottom region 143 reserved for later pouring, the prefabricated bathroom 100 of said floor is connected with the prefabricated bathroom 100 of said upper floor. The recessed top region 141 reserved for later pouring and the recessed bottom region 143 reserved for later pouring can achieve the connection between the structural walls 14 of two adjacent floors after pouring concrete. In addition, the recessed top region 141 reserved for later pouring can be also used for mounting a cast-in-situ beam, and the reinforcing bars in the recessed top region 141 can be arranged in accordance with said beam.

According to the present invention, the bottom plate unit 11 and the lower portion of each of the wall units 12 are each provided with a glass fiber reinforced plastic material layer 103, which can not only increase the toughness of the bottom plate, but also prevent water leakage. In a preferred embodiment, the glass fiber reinforced plastic material layer 103 in the bottom plate unit 11 is formed into one piece with those in the lower portions of the wall units 12. The top plate unit 13, as a part of a structural floor plate of building, is embedded therein with pipelines and light control boxes. The thickness of the top plate unit 13, e.g., about 70 mm, is smaller than the overall thickness of the building floor plate. Therefore, the use of templates can be reduced during construction, the pressure from the top plate can be reduced, and the construction difficulty and the consumption of building materials can be both reduced.

In the following the construction method of the prefabricated bathroom according to the present invention will be described. The construction method is shown in FIGS. 2 to 15, and includes the following steps.

1. Construction of the bottom plate unit 11 and the lower portions of the wall units 12

Figure 2:
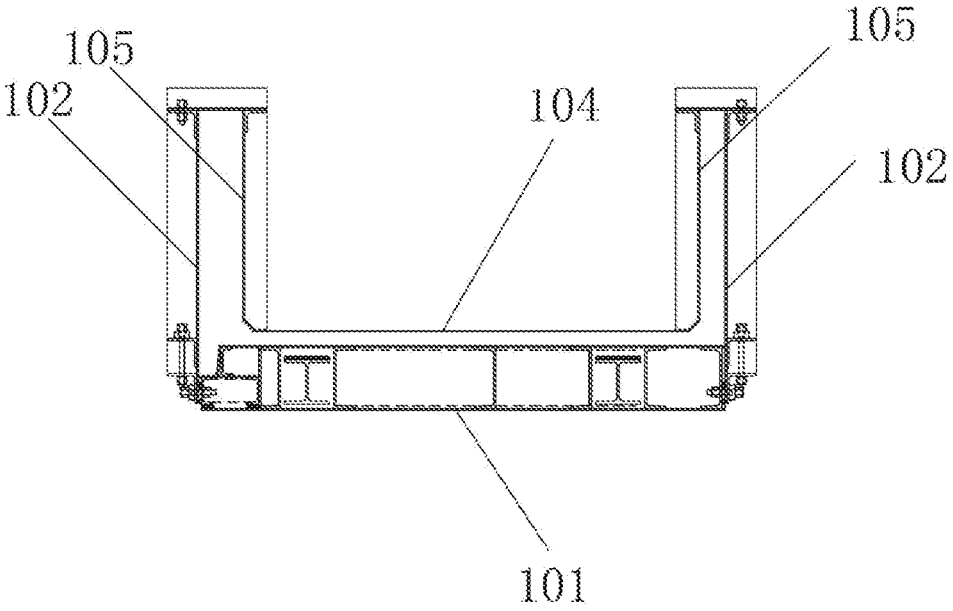
FIG. 2 schematically shows the step of building an outer steel mold for the bottom plate and a vertical steel mold of the wall unit in the construction method for the prefabricated bathroom according to the present invention.

In Step 1, outer steel molds are arranged. Specifically, as shown in FIG. 2, an outer steel mold 101 for the bottom plate of the bottom plate unit 11 of the prefabricated bathroom 100 and a first vertical outer steel mold 102 for four wall units 12 are established. The outer steel mold 101 for the bottom plate and the first vertical outer steel mold 102 are each designed as an integral template structure, which can meet the strength, rigidity and stability requirements for the prefabricated bathroom 100 during construction, and ensure no deformation, damages or collapse of the prefabricated bathroom 100 during production. The outer steel mold 101 for the bottom plate and the first vertical outer steel mold 102 are each assembled and disassembled as a whole, ensuring the components thereof have correct shapes, sizes, and mutual position relationship. In the meantime, the structure is simple, the assembly and disassembly are convenient, the surface of the mold is flat, and the joint is tight so that no leakage would occur.

Figure 3:
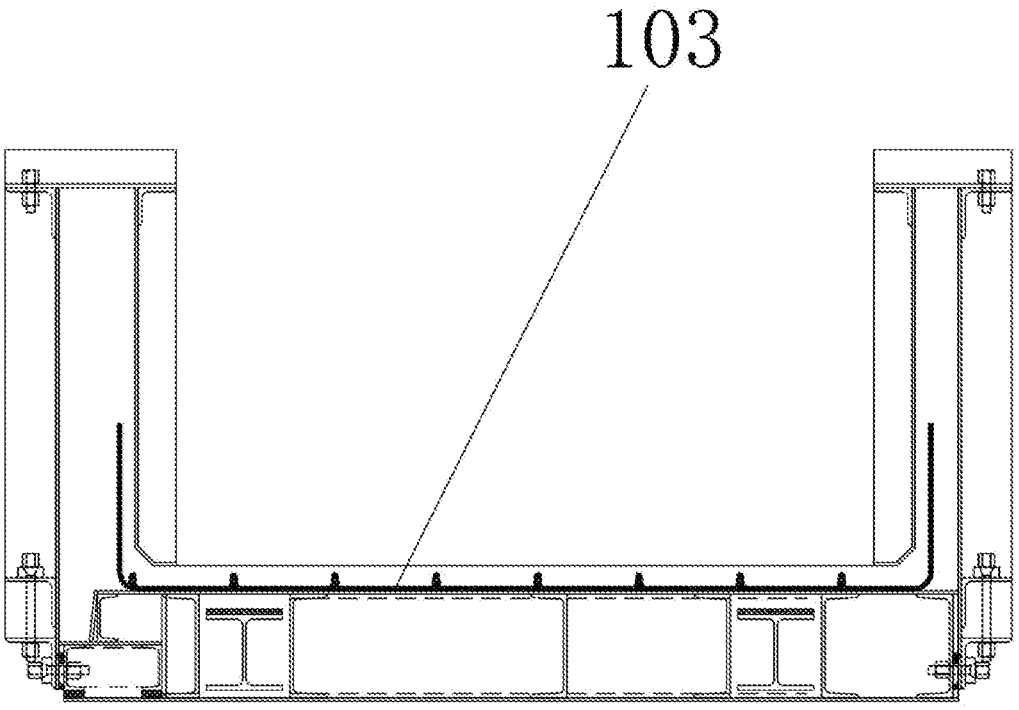
FIG. 3 schematically shows the step of disposing a glass reinforced plastic material layer in the outer steel mold for the bottom plate.

In Step 2, a glass fiber reinforced plastic material layer is arranged. Specifically, as shown in FIG. 3, the glass fiber reinforced plastic material layer 103 is placed on inner sides of the outer steel mold 101 for the bottom plate and the first vertical outer steel mold 102.

Figure 4:
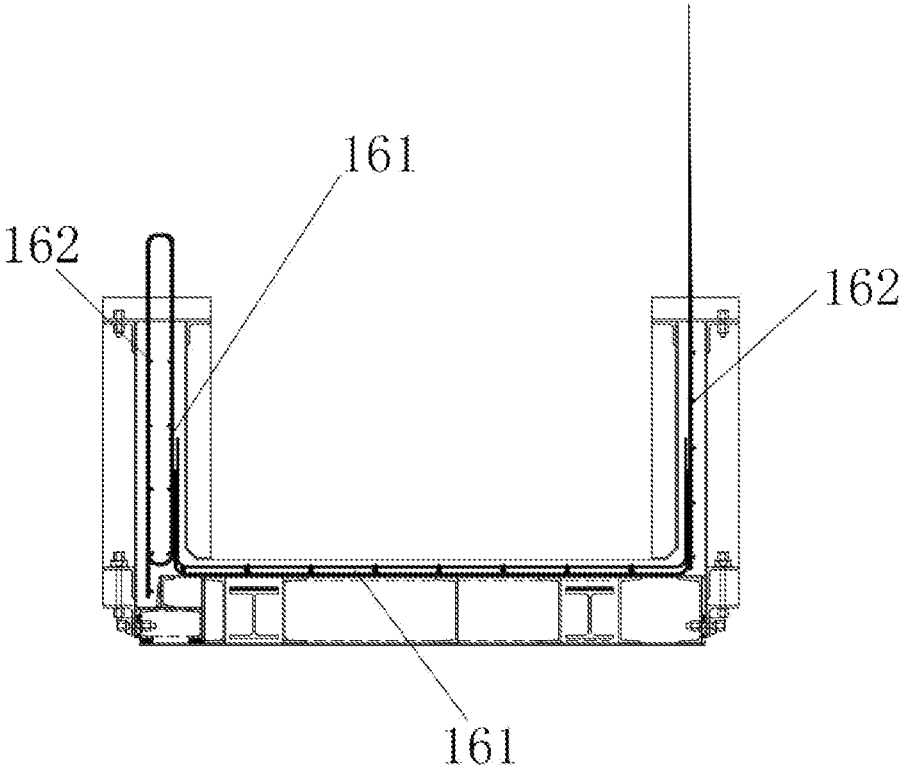
FIG. 4 schematically shows the step of bundling lateral bars with vertical bars of the bottom plate unit and the wall units in the construction method for the prefabricated bathroom according to the present invention.

In Step 3, a structural bar mesh is formed. Specifically, as shown in FIG. 4, transverse bars 161 and vertical bars 162 are firmly bundled by wires and fastened to the inner sides of the outer steel mold 101 for the bottom plate and the first vertical outer steel mold 102, so as to form a structural bar mesh for four wall units 12 and the bottom plate unit 11. The structural bar mesh is then embedded with drainage pipelines and light control boxes, respectively. The structural bar mesh of said four wall unit 12 and said bottom plate unit 11 is formed by one single process, thus maintaining the integrity of the prefabricated bathroom.

In Step 4, inner steel molds are arranged. Specifically, an inner steel mold 104 for the bottom plate of the bottom plate unit 11 of the prefabricated bathroom 100 and a first vertical inner steel mold 105 for four wall units 12 are established.

In Step 5, at a position of the lower portion of the structural wall 14 corresponding to the recessed bottom region 143 reserved for later pouring, a region is reserved for later pouring, in which bottom exposed reserve bars 146 are provided.

Figure 5:
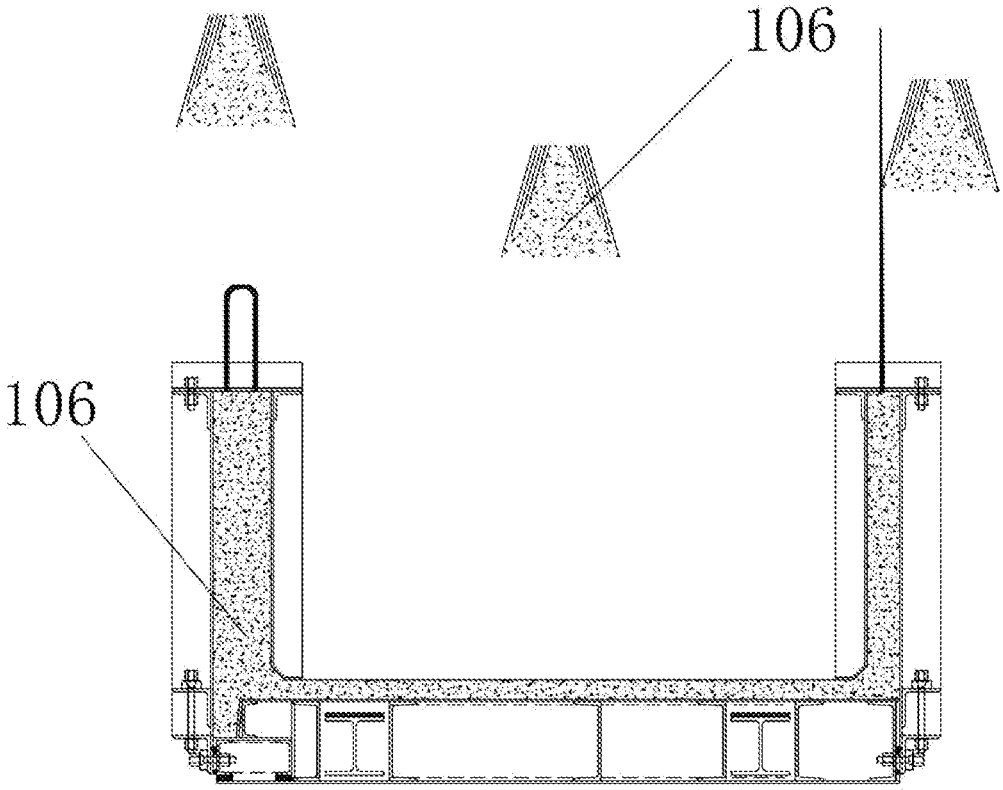
FIG. 5 schematically shows the step of pouring concrete, forming the bottom plate unit and the wall units of the prefabricated bathroom in the construction method for the prefabricated bathroom according to the present invention.
Figure 6:
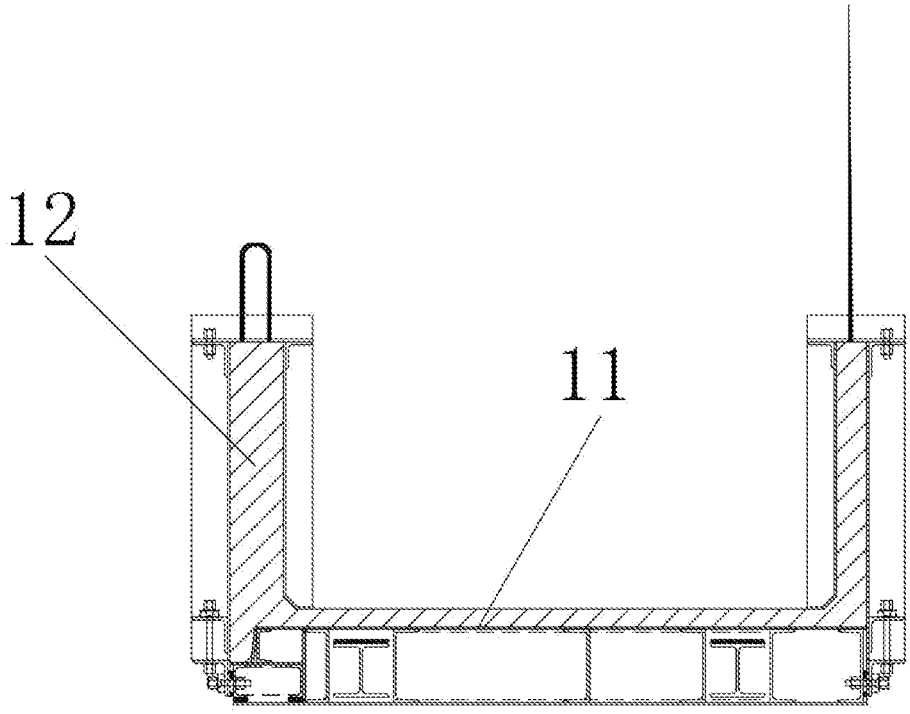
FIG. 6 schematically shows the step of removing the steel molds except the bottom plate mold in the construction method for the prefabricated bathroom according to the present invention.
Figure 7:
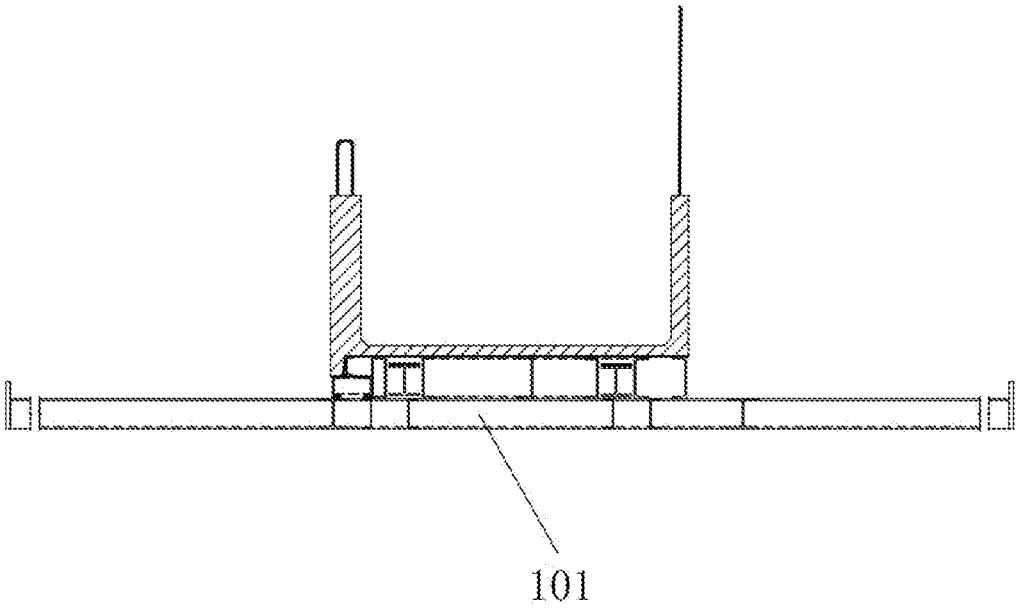
FIG. 7 schematically shows the step of removing the steel mold but leaving the final structure of the bottom plate mold in the construction method for the prefabricated bathroom according to the present invention.

In Step 6, a first concrete 106 is poured. Specifically, as shown in FIG. 5 to FIG. 7, the first concrete 106 conforming to related requirements is poured into a space defined by the outer steel mold 101 for the bottom plate, the inner steel mold 104 for the bottom plate, the first vertical outer steel mold 102, and the first vertical inner steel mold 105. After the first concrete 106 reaches required strength, the molds except the outer steel mold 101 are removed, thus forming the lower portions of four wall units 12 of the prefabricated bathroom 100 and the bottom plate unit 11. The bottom plate unit 11 consists of the glass fiber reinforced plastic material layer 103 and the first concrete 106.

2. Construction of the upper portions of the wall units 12 and the top plate unit 13

Figure 8:
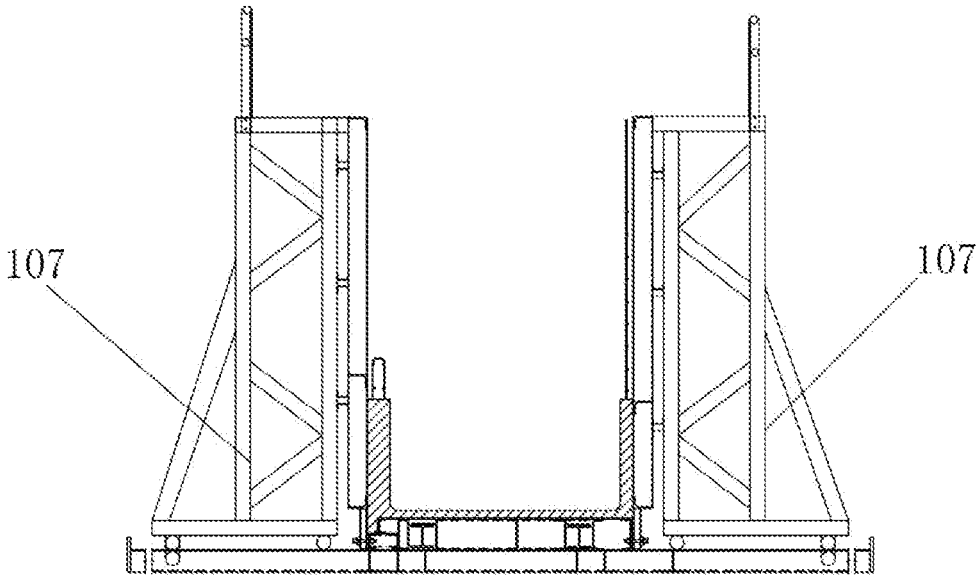
FIG. 8 schematically shows the step of installing a vertical outer steel mold in the construction method for the prefabricated bathroom according to the present invention.

In Step 7, outer steel molds are arranged. Specifically, as shown in FIG. 8, a second vertical outer steel mold 107 is arranged on the outer side of the wall units 12 that have been poured, and a pouring portion is reserved at a position corresponding to the recessed top region 141 reserved for later pouring. At the same time, the top exposed reserve bars 144 are provided in the pouring portion. Then, the bottom plate unit 11 and the wall units 12 are fixed together.

Figure 9:
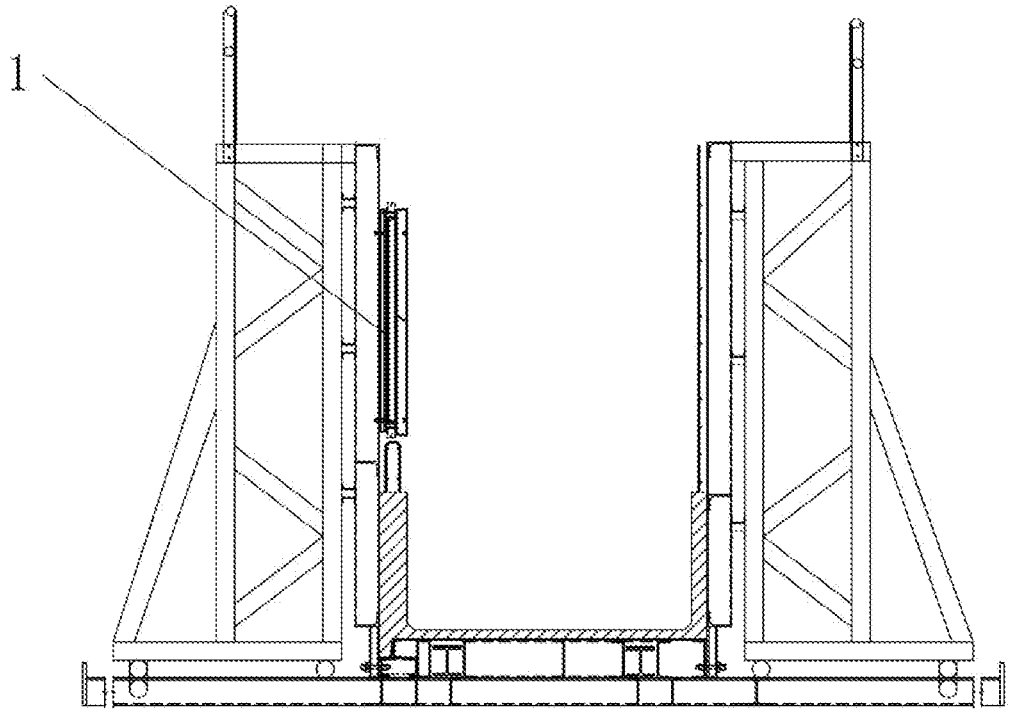
FIG. 9 schematically shows the step of installing an aluminum window frame in the construction method for the prefabricated bathroom according to the present invention.
Figure 10:
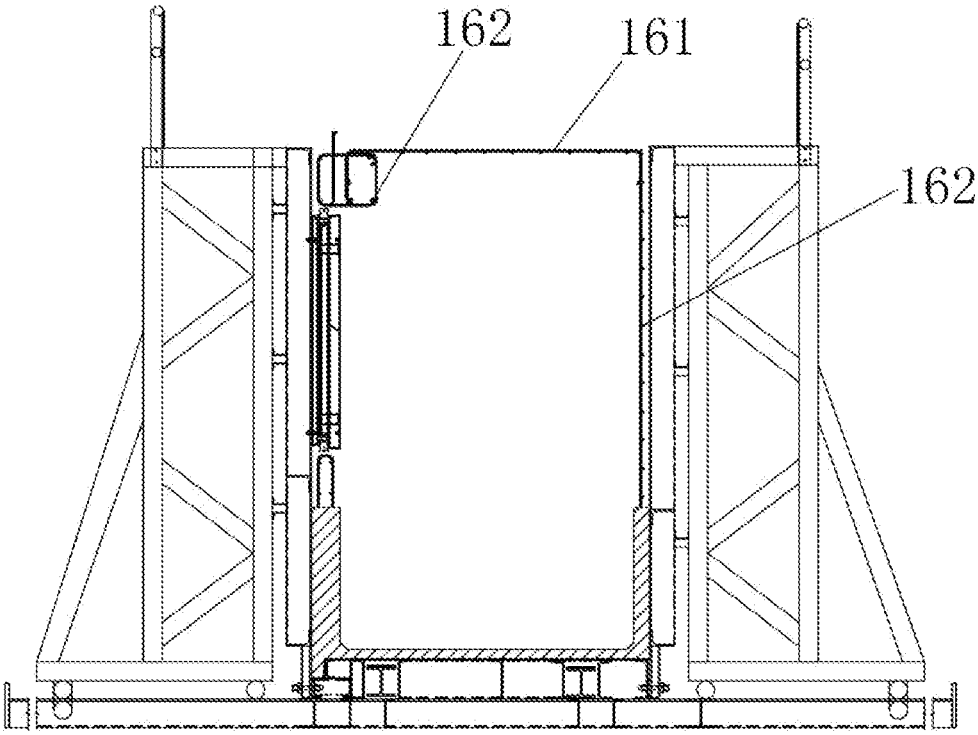
FIG. 10 schematically shows the step of bundling lateral bars with vertical bars in the construction method for the prefabricated bathroom according to the present invention.

In Step 8, an aluminum window frame 1 is installed. Specifically, as shown in FIG. 9 and FIG. 10, the aluminum window frame 1 is mounted on one of the wall units 12, and transverse bars 161 and vertical bars 162 are firmly bundled by wires and fastened on the inner side of the second vertical outer steel mold 107, thus forming a surrounding bar mesh. Then, the light control boxes and the conduits are separately fixed and embedded in the surrounding bar mesh.

In Step 9, a second vertical inner steel mold is established. Specifically, a second vertical inner steel mold (not shown) for the wall units 12 is established.

Figure 11:
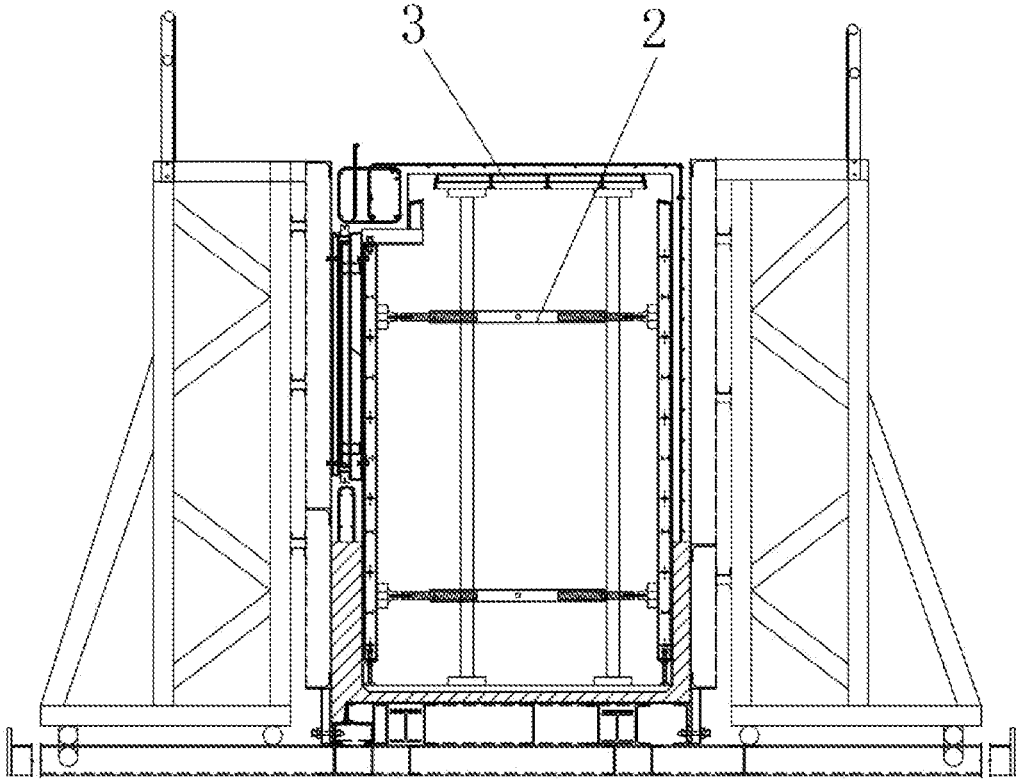
FIG. 11 schematically shows the step of installing a flange support and a single top support in the construction method for the prefabricated bathroom according to the present invention.

In Step 10, a top mold is installed. Specifically, as shown in FIG. 11, a flange support 2 and a single top support 3 are installed, so that the vertical steel molds can be kept vertical and firm by adjusting the flange support 2. The top mold is installed on the single top support 3, and bars are provided on the top mold, and formed into one piece with the bars of the wall units 12. Then, embedded light control boxes and conduits are fixed on the top mold.

Figure 12:
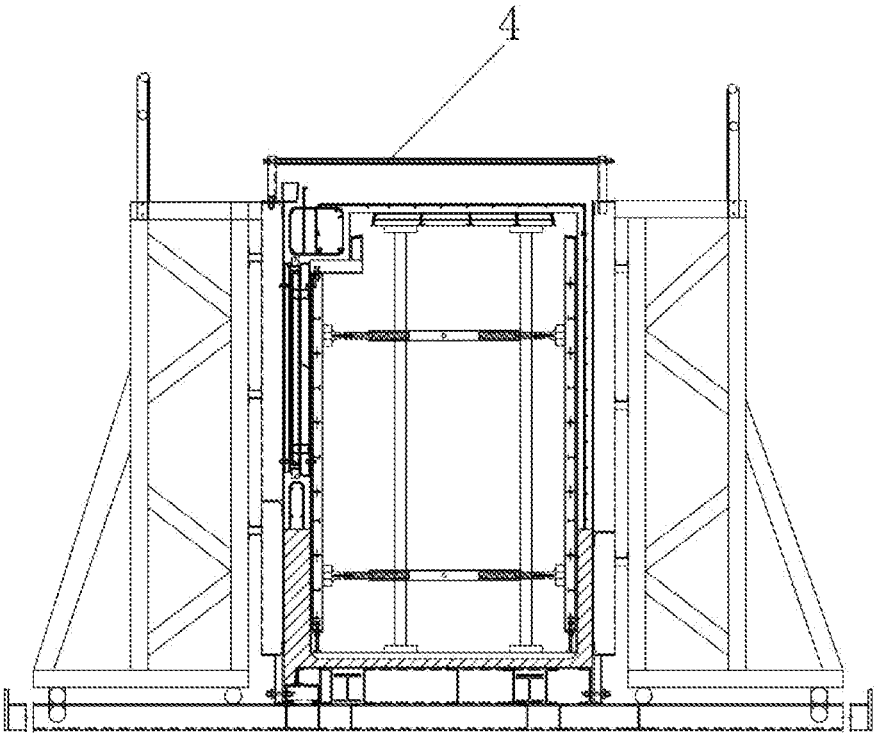
FIG. 12 schematically shows the step of installing a screw shaft in the construction method for the prefabricated bathroom according to the present invention.

In Step 11, size adjustment is performed. Specifically, as shown in FIG. 12, a screw shaft 4 is mounted on the top, in order to support the mold and adjust the size thereof, so that the mold can conform to the prefabricated bathroom 100 in terms of size.

Figure 13:
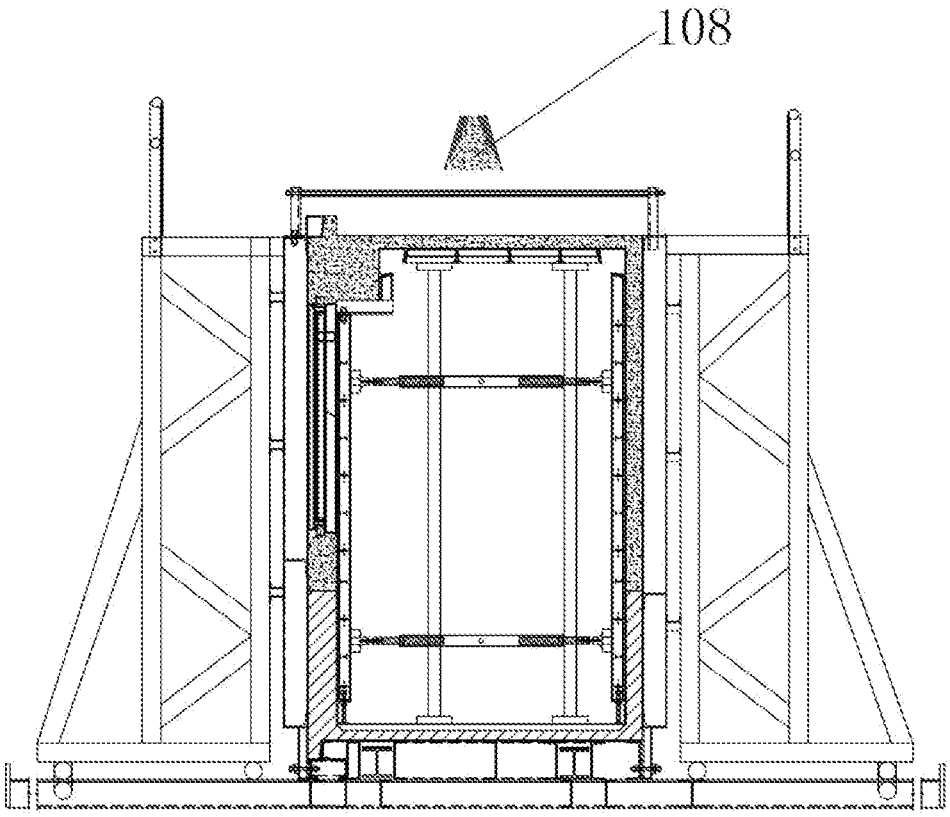
FIG. 13 schematically shows the step of pouring concrete in the construction method for the prefabricated bathroom according to the present invention.
Figure 14:
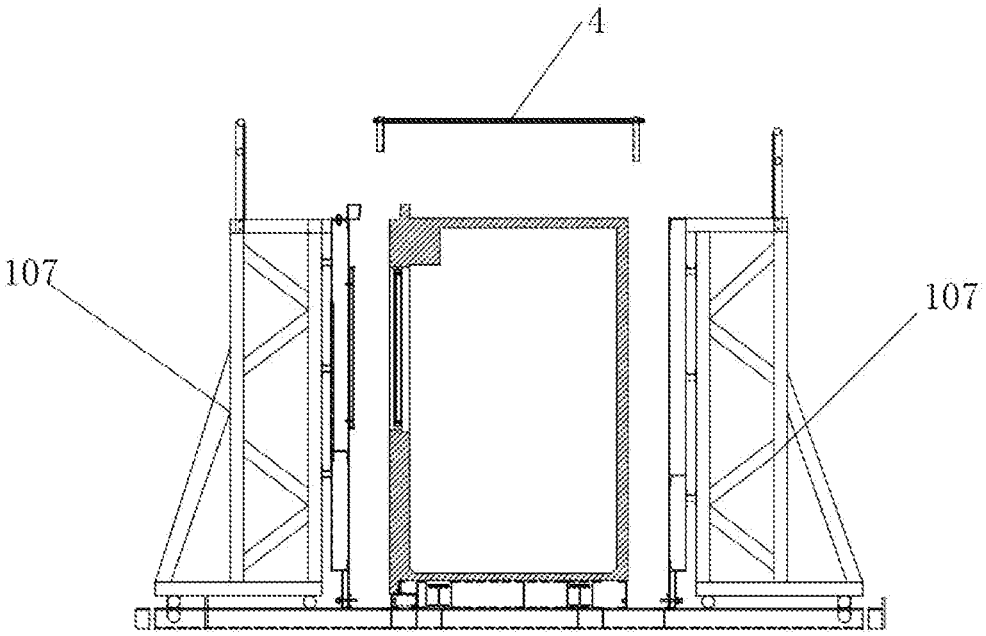
FIG. 14 schematically shows the step of removing the molds in the construction method for the prefabricated bathroom according to the present invention.

In Step 12, a second concrete 108 is poured. Specifically, as shown in FIG. 13, a second concrete 108 is poured in a space defined by the vertical outer steel molds and the vertical inner steel molds of the wall units 12 and the top mold of the top plate unit 13. As shown in FIG. 14, after the second concrete 108 reaches required strength, all the molds, supports or the like are removed. Then, the product can be lifted to the area where the prefabricated bathroom 100 is decorated.

Since a portion for pouring the recessed bottom region 143 and the bottom exposed reserve bars 146 are provided in Step 5, and a portion for pouring the recessed top region 141 and the top exposed reserve bars 144 are provided in Step 7, the recessed bottom region 143 reserved for later pouring and the bottom exposed reserve bars 146 will be formed at the lower portion of the structural wall 14, while the recessed top region 141 reserved for later pouring and the top exposed reserve bars 144 will be formed at the upper portion of the structural wall 14, after the concrete is poured.

Figure 15:
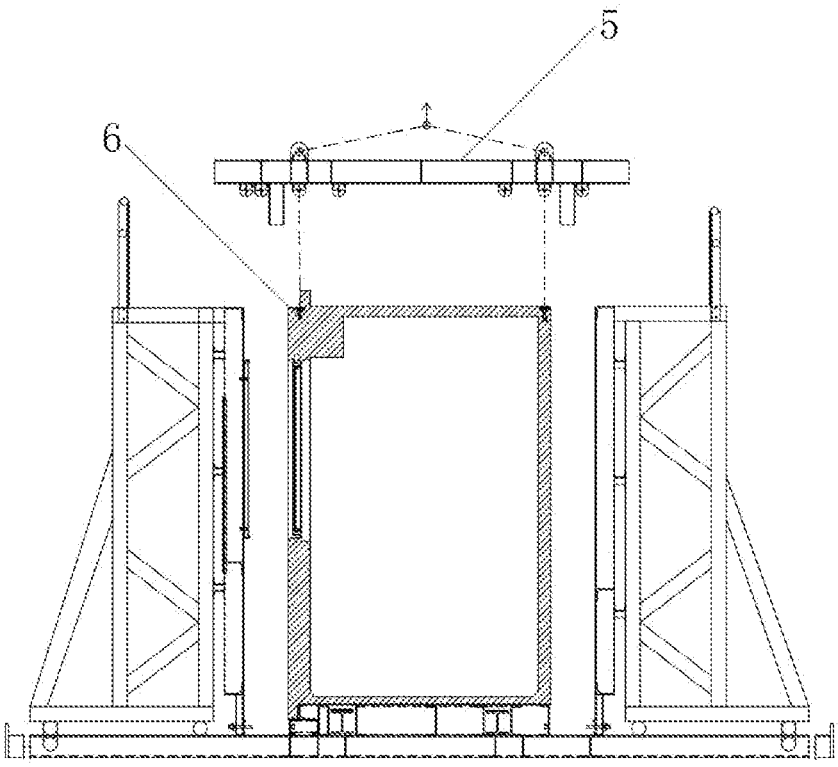
FIG. 15 schematically shows the step of hoisting and transferring the product after removing the molds in the construction method for the prefabricated bathroom according to the present invention.

The prefabricated bathroom 100 according to the present invention can be constructed through the above-mentioned steps. As shown in FIG. 15, through engagement of a steel hook 6 with a hanger 5, the prefabricated bathroom 100 can be lifted and transferred to a designated place for installation.

In the following the on-site installation method of the prefabricated bathroom 100 according to the present invention will be described. The on-site installation method is as shown in FIGS. 16 to 25, and includes the following steps.

In Step 1, a floor for installing the prefabricated bathroom 100 is designated, and accordingly, a top plate 7 of the floor is cleaned.

Figure 16:
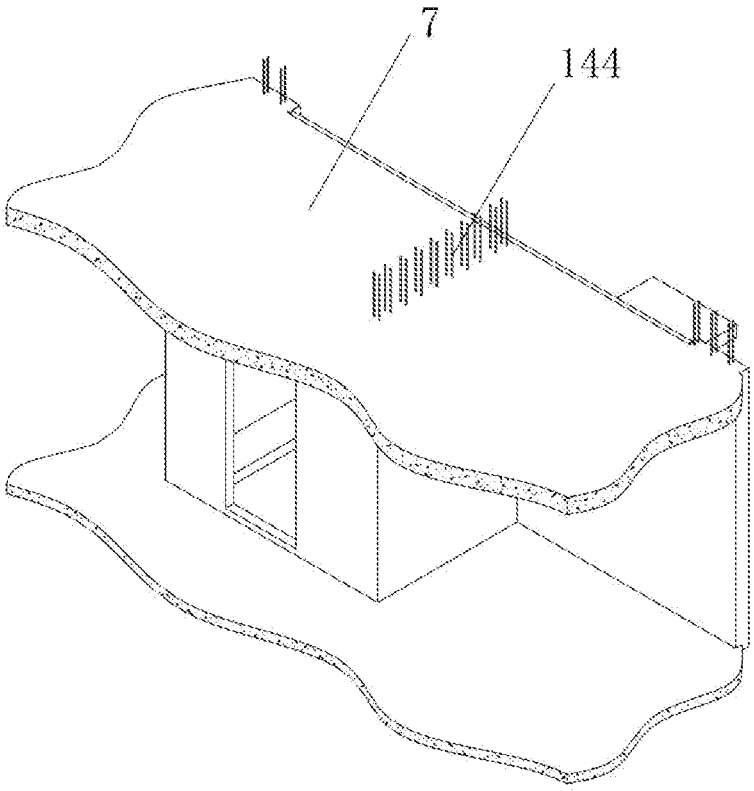
FIG. 16 schematically shows the step of laying concrete slurry in the installation method for the prefabricated bathroom according to the present invention.

In Step 2, as shown in FIG. 16, a layer of concrete mortar is applied on the top of the cleaned floor 7 in a region where the prefabricated bathroom 100 is placed.

Figure 17:
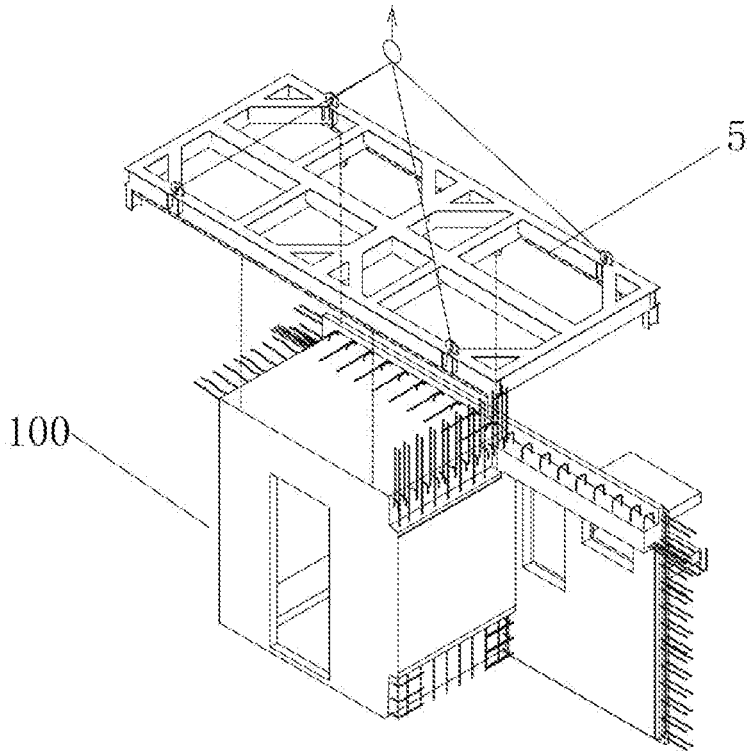
FIG. 17 schematically shows the step of hoisting and installing the prefabricated bathroom in the installation method for the prefabricated bathroom according to the present invention.

In Step 3, as shown in FIG. 17, the prefabricated bathroom 100 is lifted to the designated position on the installation site. At this time, the top exposed reserve bars 144 of the bathroom of a next floor are inserted into the recessed bottom region 143 reserved for later pouring of the prefabricated bathroom of said floor.

Figure 18:
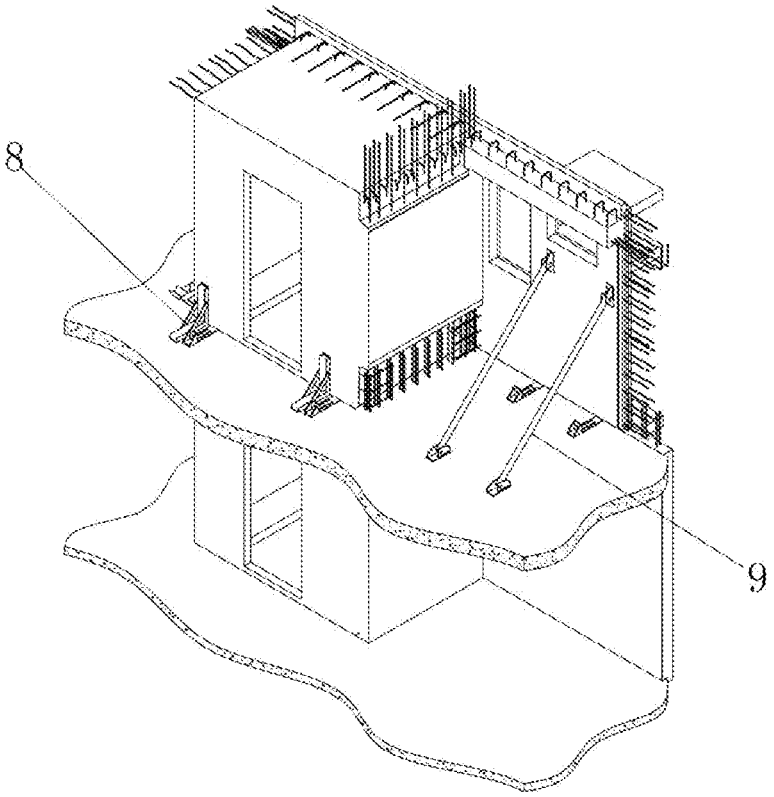
FIG. 18 schematically shows the step of installing foot stools and diagonal bracings in the installation method for the prefabricated bathroom according to the present invention.
Figure 19:
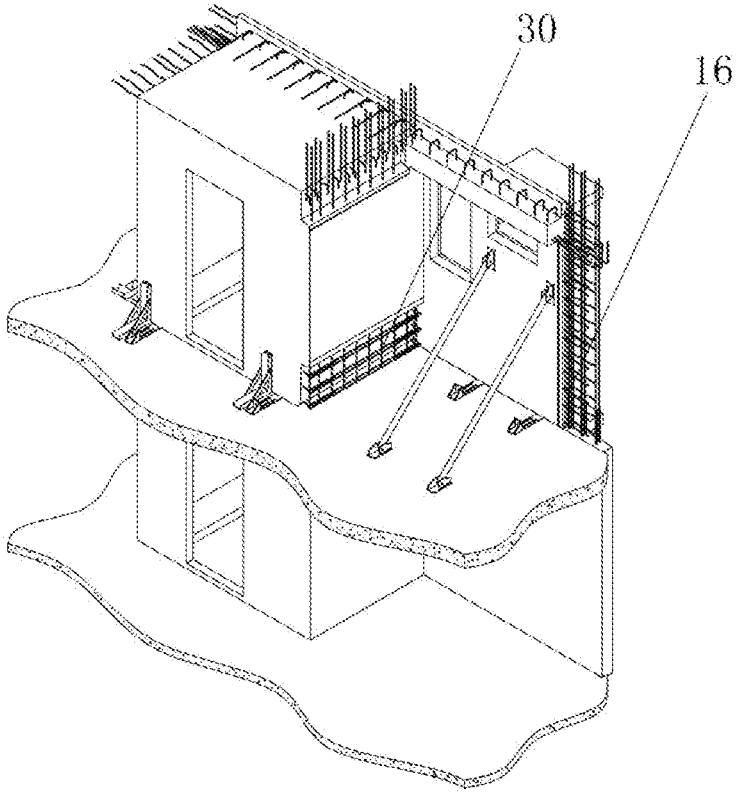
FIG. 19 schematically shows the step of bundling bars at an outside of the structural wall and bundling bars at a later-pouring region of the exterior wall in the installation method for the prefabricated bathroom according to the present invention.

In Step 4, as shown in FIG. 18, foot stools 8 and diagonal bracings 9 are mounted to fix the prefabricated bathroom 100 on the top plate 7 of said floor;

In Step 5, as shown in FIG. 19, the bottom exposed reserve bars 146 in the recessed bottom region 143 reserved for later pouring of the prefabricated structural wall 14 are bundled with the top exposed reserve bars 144 of said next floor, and the vertical bars 162 are bundled with the transverse bars 161, forming the structural wall bar mesh 30. In addition, the side exposed reserve bars 21 at the end of the exterior wall unit 20 are bundled with the transverse bars 161 and the vertical bars 162, thus forming the bar mesh 16.

Figure 20:
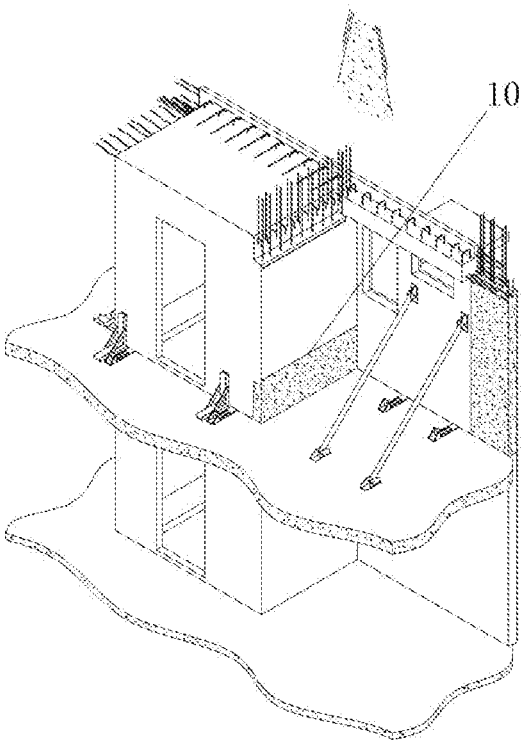
FIG. 20 schematically shows the step of installing templates for the cast-in-situ wall and the later-pouring region of the exterior wall, and pouring concrete in the installation method for the prefabricated bathroom according to the present invention.

In Step 6, as shown in FIG. 20, cast-in-situ wall templates are installed at positions respectively corresponding to the recessed bottom region 143 reserved for later pouring and the bar mesh 16 arranged at the end of the exterior wall unit 20. The concrete which meets related requirements is poured into the cast-in-situ wall templates, thus forming the cast-in-situ structural wall 10 and the exterior wall.

Figure 21:
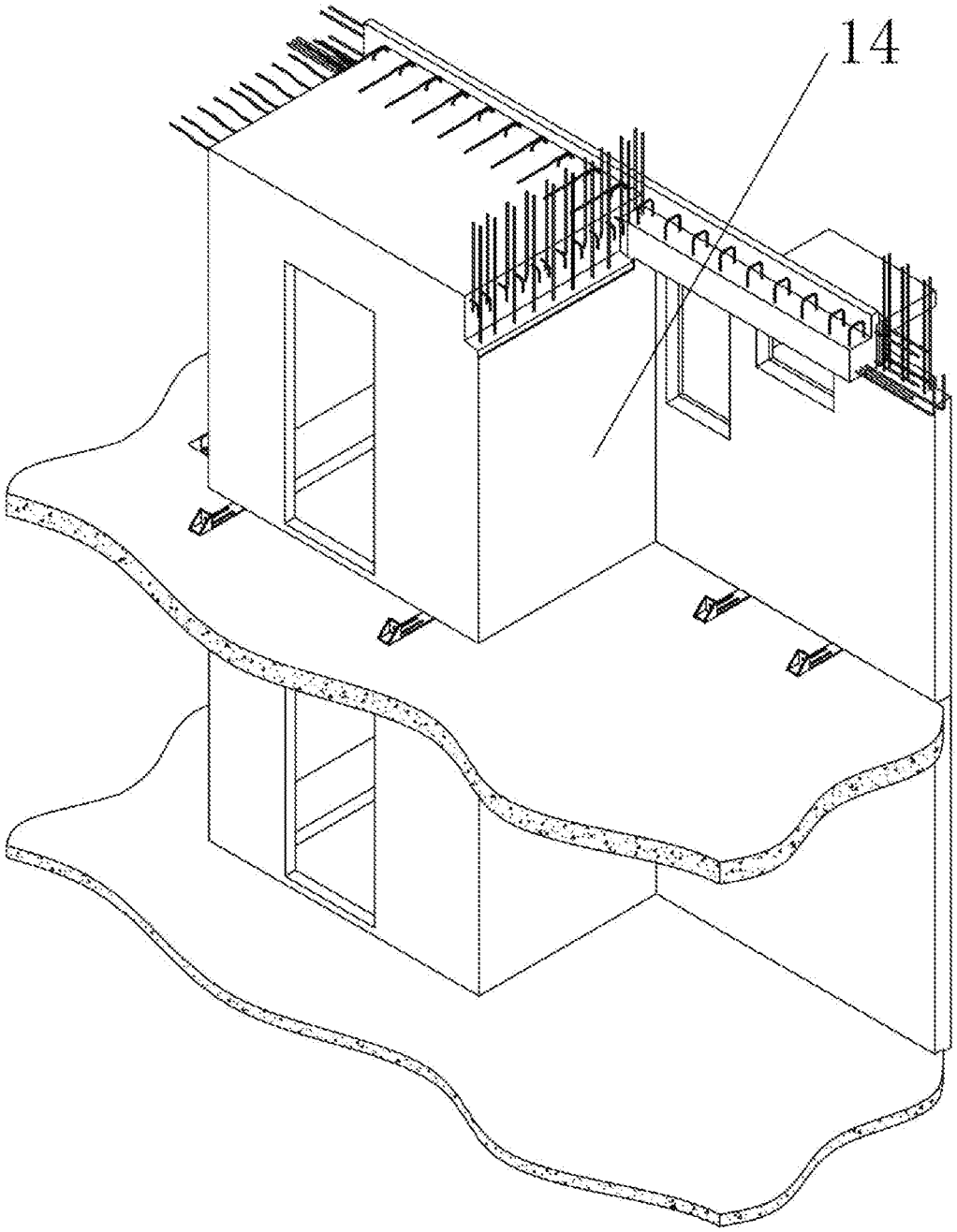
FIG. 21 schematically shows the step of removing foot stools and diagonal bracings in the installation method for the prefabricated bathroom according to the present invention.

In Step 7, as shown in FIG. 21, the foot stools 8 and the diagonal bracings 9 are removed.

Figure 22:
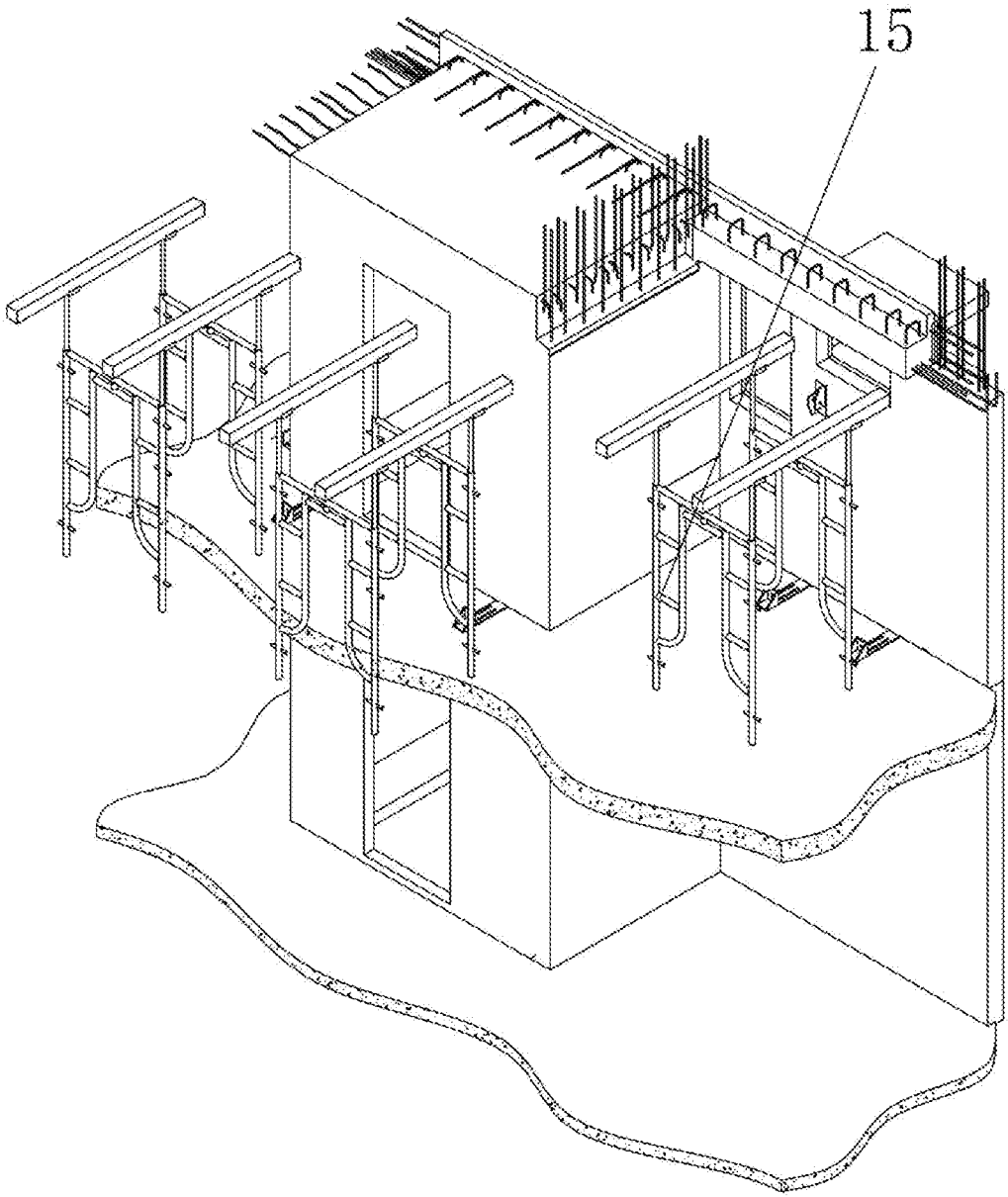
FIG. 22 schematically shows the step of establishing scaffolds in the installation method for the prefabricated bathroom according to the present invention.

In Step 8, as shown in FIG. 22, scaffolds 15 are established around the prefabricated bathroom 100, for supporting a semi-prefabricated floor plate 17.

Figure 23:
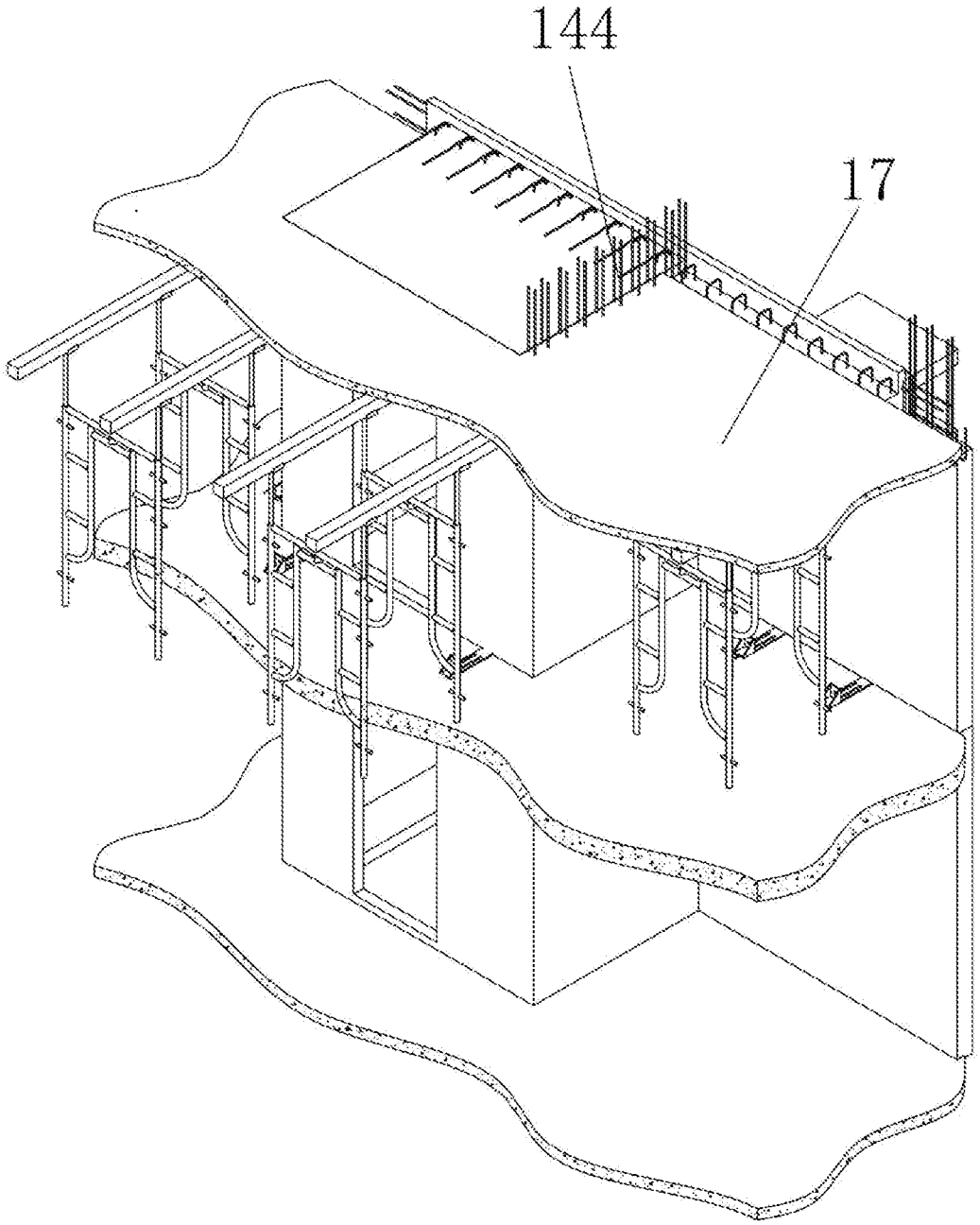
FIG. 23 schematically shows the step of installing a semi-prefabricated floor plate in the installation method for the prefabricated bathroom according to the present invention.

In Step 9, as shown in FIG. 23, the semi-prefabricated floor plate 17 is hoisted on the top of the scaffolds 15.

Figure 24:
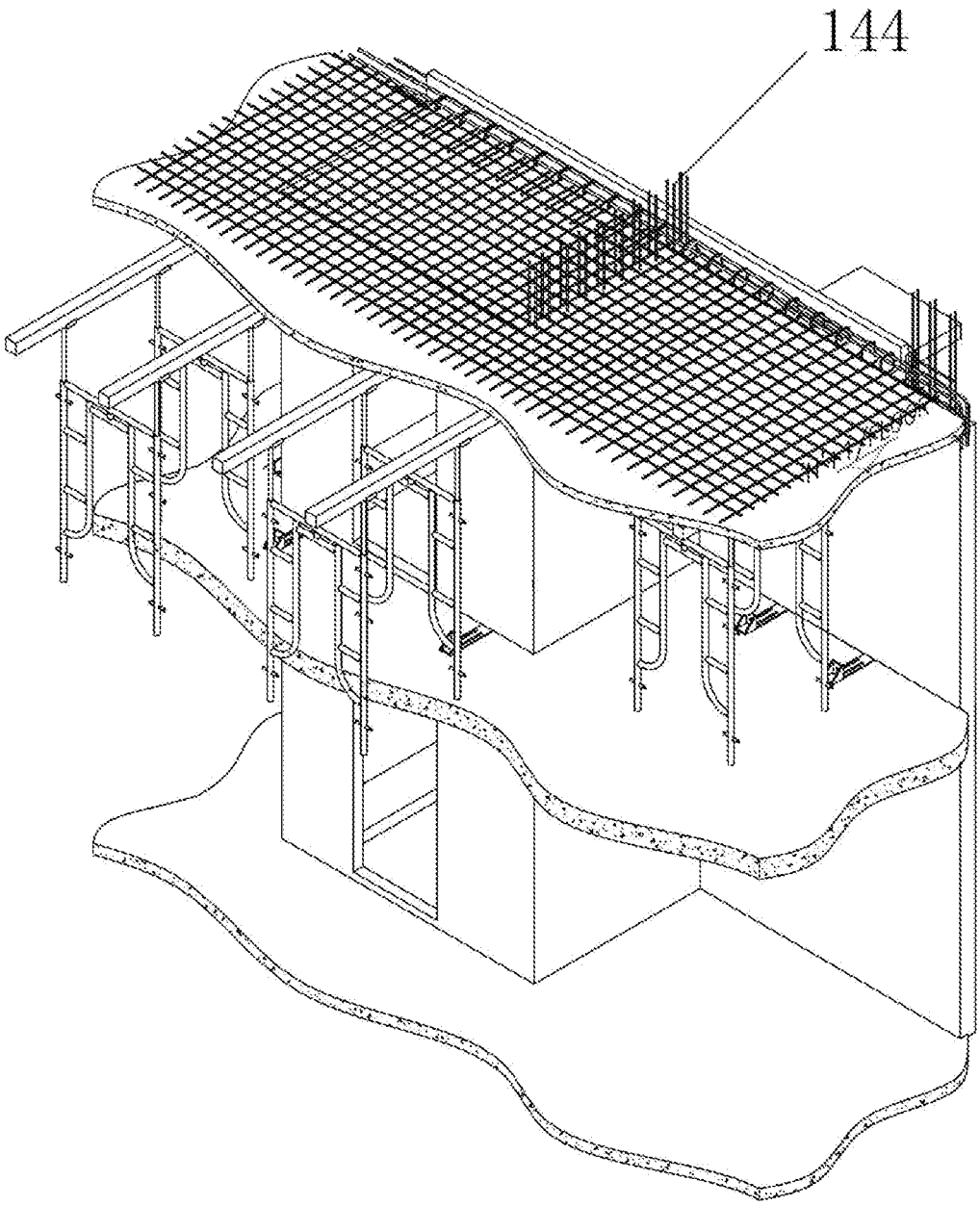
FIG. 24 schematically shows the step of bundling the bars of the semi-prefabricated floor plate and the bars at the top of the bathroom, embedding light control boxes, wire conduits and related accessories, and pouring concrete in the installation method for the prefabricated bathroom according to the present invention.

In Step 10, as shown in FIG. 24, bars at the top of the semi-prefabricated floor plate 17 and bars at the top of the bathroom are bundled together, the light control boxes, the conduits and related accessories are embedded, and then concrete is poured on the bars.

Figure 25:
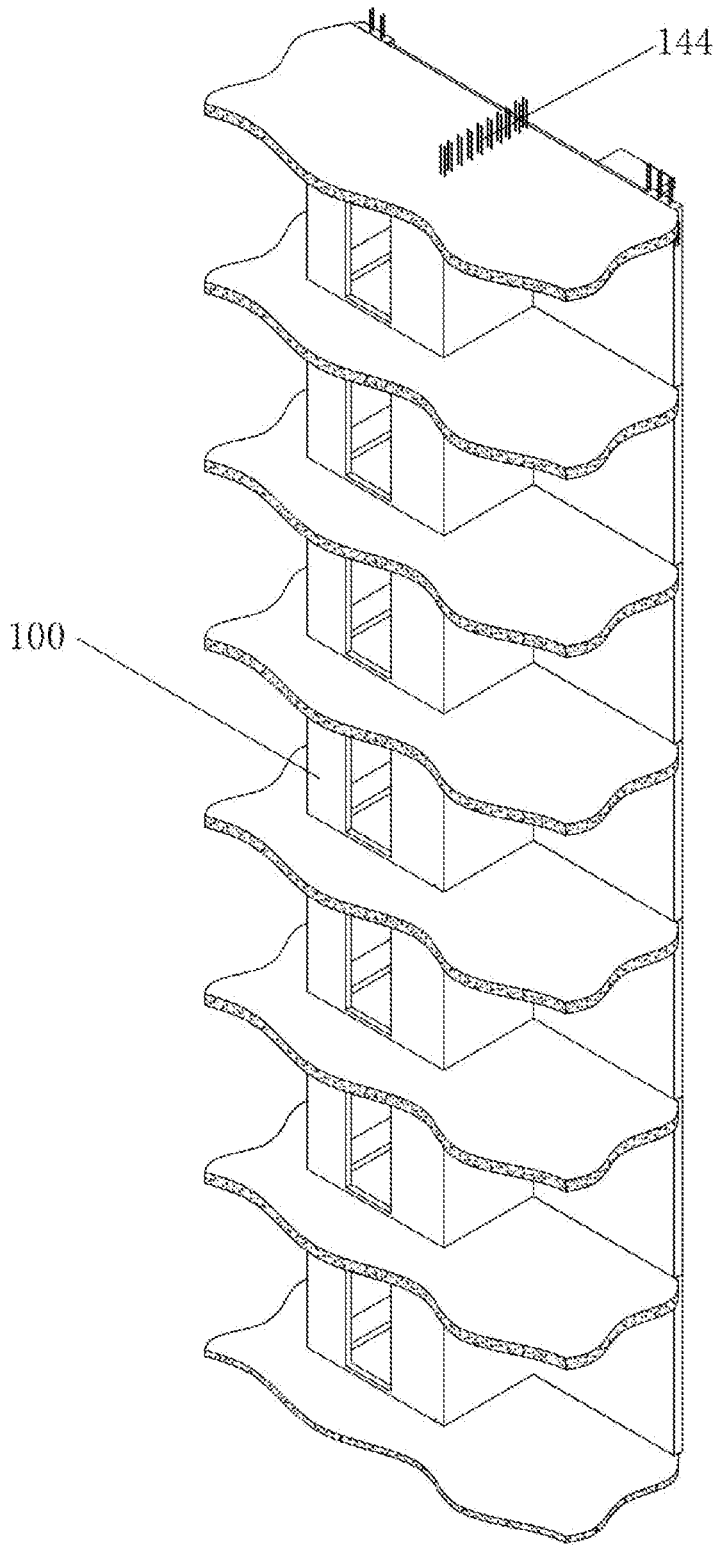
FIG. 25 schematically shows a plurality of floors each having a prefabricated bathroom installed thereon.

In Step 11, as shown in FIG. 25, the above steps 1 to 10 are repeated.

The advantages of the present invention are as follows.

1. One of the wall units 12 is a structural wall 14, which increases the bearing capacity.

2. The top and bottom regions of the structural wall 14 are both semi-prefabricated, while the middle region thereof is a full-prefabricated structural wall. Therefore, the integrity of the structural wall 14 is ensured.

3. The bottom plate unit 11 is composed of a concrete layer and the glass reinforced plastic material layer 103.

Therefore, the bottom plate unit 11 has improved toughness, and can effectively prevent water seepage.

4. The prefabricated bathroom 100 is provided with the toilet 19 and the bathtub 18, so that it is more convenient to use.

5. The top plate unit 13 has a smaller thickness than that of conventional prefabricated bathrooms 100. Therefore, the use of templates can be reduced during construction, the pressure from the top plate on the wall units 12 can be reduced, and the construction difficulty and the consumption of building materials can be reduced.

6. According to the construction method for the prefabricated bathroom of the present invention, the bottom outer steel mold 102 and the first vertical outer steel mold 102 are each assembled and disassembled as a whole, and the top plate unit 13 and the upper portions of the surrounding wall units 12 are formed by pouring concrete once, thus obtaining tight joints without slurry leakage. Therefore, the waterproof performance of the prefabricated bathroom 100 is improved.

7. According to the installation method for the prefabricated bathroom of the present invention, the top exposed reserve bars 144 of the prefabricated bathroom 100 of a floor are inserted into the semi-prefabricated toothed joint of the prefabricated bathroom 100 of a next floor, and connected with the bottom exposed reserve bars 146 thereof. Therefore, accurate installing and positioning procedure is unnecessary, and the construction efficiency is improved.

While the invention has been described in conjunction with the preferred embodiments outlined above, it is evident that many alternatives, modifications and variations will be apparent to those skilled in the art. Various changes may be made without departing from the spirit and scope of the invention as defined in the following claims.

The invention claimed is:

1. A prefabricated bathroom, comprising a bottom plate unit (11), multiple wall units (12) and a top plate unit (13) that are connected to each other in a securing manner, wherein one of the wall units (12) is a structural wall (14), which is provided, at its top portion, with a recessed top region (141) reserved for later pouring, the recessed top region (141) being provided therein with top exposed reserve bars (144), and wherein the recessed top region of the structural wall is an upwardly facing recessed top region that includes a laterally facing surface and extends a longitudinal extent the entire width of the structural wall, said structural wall (14) is configured as a full-prefabricated structural wall body (142) at a middle portion of the structural wall (14), and is provided, at a bottom portion of the structural wall (14), with a recessed bottom region (143) reserved for later pouring, the recessed bottom region (143) being provided therein with bottom exposed reserve bars (146), and wherein the recessed bottom region of the structural wall is a downwardly facing recessed bottom region that includes a laterally facing surface and extends a longitudinal extent the entire width of the structural wall, and the top exposed reserve bars (144) of a prefabricated bathroom located on a floor are inserted into the recessed bottom region (143) of a prefabricated bathroom located on a next floor, and connected with the bottom exposed reserve bars (146) thereof, so that the prefabricated bathroom of said floor can be connected with the prefabricated bathroom of said next floor through pouring concrete in the recessed top region (141) and the recessed bottom region (143), wherein the top exposed reserve bars of the prefabricated bathroom located on the floor are inserted into the downwardly facing recessed bottom region of the prefabricated bathroom located on a next floor and joined with the bottom exposed reserve bars thereof, whereby the prefabricated bathroom of the floor can be connected with the prefabricated bathroom of the next floor through pouring concrete in the upwardly facing recessed top region and the downwardly facing recessed bottom region.

2. The prefabricated bathroom according to claim 1, wherein the bottom plate unit (11) and low portions of the wall units (12) are provided with a glass reinforced plastic material layer (103).

3. The prefabricated bathroom according to claim 1, wherein the recessed top region (141) and the recessed bottom region (143) are arranged on an outer side of the structural wall (14), and inner sides of the recessed top region (141) and the recessed bottom region (143) are provided with toothed engagement surfaces (151, 152) respectively.

4. The prefabricated bathroom according to claim 1, wherein the prefabricated bathroom is provided therein with a toilet (19) and a bathtub (18).

5. The prefabricated bathroom according to claim 1, wherein one of the wall units (12) other than the structural wall (14) extends outwardly to form an exterior wall unit (20), an end of which is provided with side exposed reserve bars (21).

6. A method for constructing the prefabricated bathroom claim 1, comprising the following steps:

Step A: building the bottom plate unit (11) and the lower portions of said multiple wall units (12) with a bottom plate steel mold and a vertical steel mold, bundling the bars of the bottom plate unit (11) and the wall units (12), and pouring concrete;

Step B: forming the recessed bottom region (143) reserved for later pouring at a bottom part of the structural wall (14), and providing exposed bars in the recessed bottom region (143);

Step C: building the upper portions of said multiple wall units (12) and the top plate unit (13) with a vertical steel mold of the wall units (12) and a top mold arranged at the top of the top plate unit (13), bundling the bars of the top plate unit (13) and the wall units (12), and pouring concrete; and Step D: forming the recessed top region (141) reserved for later pouring at a top part of the structural wall (14), and providing exposed bars in the recessed top region (141).

7. The method for constructing the prefabricated bathroom according to claim 6, wherein Step A further includes: disposing the glass reinforced plastic material layer at a position of the bottom plate unit (11) before bundling the bars of the bottom plate unit (11) and the wall units (12), wherein edges of the glass reinforced plastic material layer extend upwardly to the lower portions of the wall units (12).

8. A method for installing the prefabricated bathroom according to claim 1, comprising the following steps:

Step A: lifting the prefabricated bathroom (100) to a designated position of a floor plate of a floor to be installed with the prefabricated bathroom;

Step B: bundling the bottom exposed reserve bars (146) of the recessed bottom region (143) of the structural wall (14) with the top exposed reserve bars (144) of the prefabricated bathroom of a next floor that are inserted into said recessed bottom region (143) together, forming a bar mesh; and Step C: installing a cast-in-situ wall template outside said recessed bottom region (143), and pouring concrete in said recessed bottom region (143) to form a cast-in-situ wall (10).

9. The method for installing the prefabricated bathroom according to claim 8, wherein after Step C, the method further includes, Step D: establishing scaffolds (15) around the prefabricated bathroom of said floor at positions where the floor plate is poured, and lifting a semi-prefabricated floor plate (17) to the prefabricated bathroom (100) and mounting it on the top of the scaffolds (15); and Step E: bundling bars on the top of prefabricated bathroom (100) and on the top of the semi- prefabricated floor plate (17) to form a bar mesh, on which concrete is poured to form the whole floor plate.

10. The method for installing the prefabricated bathroom according to claim 9, wherein in Step F, concrete is further poured in the recessed top region (141) of the prefabricated bathroom (100) of said next floor during pouring the floor plate.

* * * * *